United States Patent [19]

Gamberini

[11] 4,006,578

[45] Feb. 8, 1977

[54] CONVEYOR FOR CONVEYING CAPSULES IN MACHINES FOR FILLING SAID CAPSULES WITH DOSES OF PULVERULENT OR GRANULAR PRODUCT

[76] Inventor: Ernesto Gamberini, via Udine, 6, Bologna, Italy

[22] Filed: Oct. 21, 1975

[21] Appl. No.: 624,638

[30] Foreign Application Priority Data

Nov. 6, 1974 Italy ..... 3515/74

[52] U.S. Cl. ..... 53/282

[51] Int. Cl.[2] ..... B65B 1/04

[58] Field of Search ..... 53/282

[56] References Cited

UNITED STATES PATENTS 3,527,015 9/1970 Aronson et al. ..... 53/282 X 3,666,085 5/1972 Folkes ..... 198/203 X

*Primary Examiner*—Travis S. McGehee

*Attorney, Agent, or Firm*—Guido Modiano; Albert Josif

[57] ABSTRACT

A conveyor for conveying capsules consisting of a case and a cap in machines for filling these capsules with granular or powder material which comprises a pair of endless toothed belts lying in two horizontal planes wound about idle pulleys, a plurality of blocks being supported at equal distances along the belts, each block of the upper belt being provided with a seat for housing the cap of one capsule, and each block of the lower belt being provided with a seat for housing the case of the same capsule.

2 Claims, 3 Drawing Figures

CONVEYOR FOR CONVEYING CAPSULES IN MACHINES FOR FILLING SAID CAPSULES WITH DOSES OF PULVERULENT OR GRANULAR PRODUCT

This invention relates to a conveyor for conveying capsules in machines for filling said capsules with doses of pulverulent or granular product.

These capsules are used for example in the pharmaceutical industry for containing antibiotics.

Such capsules notably consist of a case and cap, and are fed to the filling machines in bulk in the closed state.

In known continuously operating machines, the capsules are firstly taken one at a time and disposed vertically such that the cap of the capsule lies above the corresponding case. The cap and case of each capsule are housed in vertically aligned sockets supported by respective chains, which form the conveyor for conveying the capsules towards the filling station.

Before the capsules reach the filling station, the cap is separated from the case and this latter is moved laterally to allow the predetermined dose of product to be inserted.

After filling, the two sockets supporting the cap and case of the same capsule are again aligned and the cover mounted on the case. The known conveyor presents certain disadvantages. The need to move the case support sockets laterally relative to the cap support sockets to allow the product dose to be inserted into the case requires means for tensioning the chains which make the conveyor mechanically complicated. Moreover the chains require constant lubrication, which creates cleaning problems which are difficult to overcome in machines used in the pharmaceutical industry.

The object of the present invention is consequently to provide a conveyor in which the aforementioned disadvantages are substantially eliminated. This object is attained by a conveyor for conveying capsules consisting of a case and cap in machines for filling said capsules with doses of pulverulent or granular product and which comprise an assembly for feeding the capsules in their closed state and incorporating means for separating the case from the cap, a dispensing assembly arranged to insert a predetermined product dose into the capsule case, and a capsule closing assembly, the conveyor comprising a pair of toothed belts of equal length in the form of endless loops and lying in two horizontal planes, the belts being wound about idle pulleys to convey the capsules from the feed assembly to the dispensing assembly and from this latter to the closing assembly, a plurality of blocks supported at equal distances along the belts, each block of the upper belt being provided with a seat for housing the cap of one capsule, and each block of the lower belt being provided with a seat for housing the case of the same capsule, the seat being mutually aligned at least when in a position corresponding with the capsule feed assembly, to receive the capsule.

Further details of the invention will be more evident from the description given hereinafter of one embodiment illustrated by way of example in the accompanying drawing, in which.

Figures 1, 2, 3:
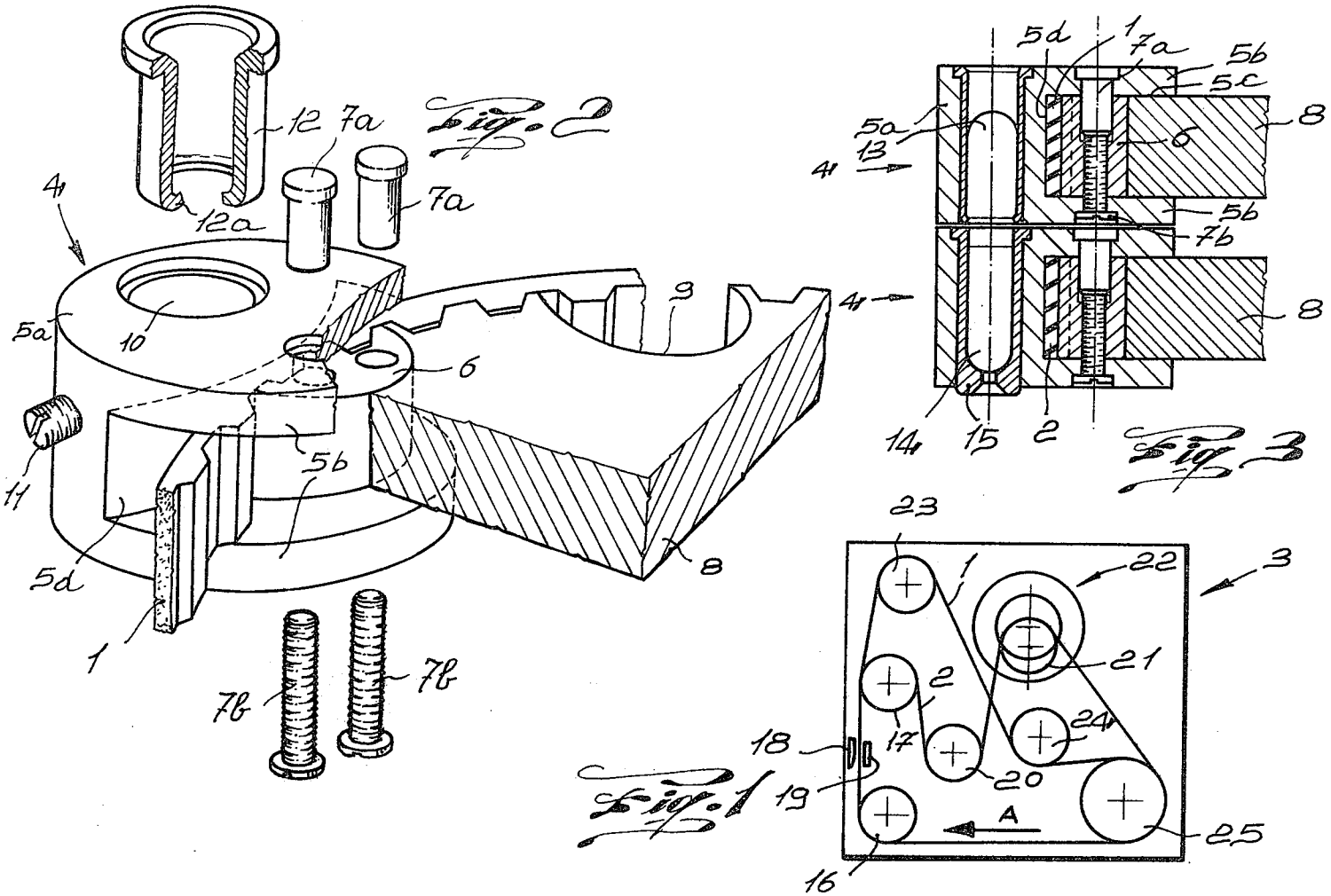
FIG. 1 is a schematical plan view of the conveyor according to the invention, in a capsule filling machine.
FIG. 2 is a perspective view of a detail of the conveyor, with parts shown in section to clarify certain constructional details.
FIG. 3 is a vertical section through the conveyor.

With particular reference to these figures, the conveyor comprises a pair of equal internally toothed belts 1, 2 in the form of an endless loop. The belts 1, 2 lie in overlying horizontal planes and move with continuous motion in the direction of the arrow A. The conveyor forms part of a machine 3 of substantially known type for filling capsules with pulverulent or granular product doses. Like blocks, indicated overall by the reference numeral 4, are fixed along the belts 1, 2 with constant pitch and in mutual phase. In the description given hereinafter, reference will only be made to the blocks of the upper belt 1, those of the lower belt being entirely analogous.

Each block consists of a first substantially cylindrical element comprising a part **5*a* external to the belt 1 and a species of fork consisting of two arms 5*b*, one upper and one lower, which project beyond the internal boundary of the belt. The arms 5*b* form the upper and lower limits of a cavity 5*c*, the base 5*d*** of which is convex curved.

The second element 6 of the block is located between the arms **5*b*. The element 6 is locked between the arms 5*b* by a pair of screws 7*b* which screw into headed nuts 7*a* which abut on the upper arm and penetrate into holes in the element 6. The element 6 is located internal to the belt and that surface of it facing this latter comprises a toothing complementary to the toothing of the belt and of the same curvature as the toothing of the wheels 8 about which the belts 1, 2 are wound at the various units of the machine 3. That surface of the element opposite the toothing is cylindrical and concentric with the peripheral surface of the element 5*a*, 5*b* and is of smaller diameter than this latter. When the belt engages with the toothing of the wheels 8, the elements 6 engage in cavities 9 formed peripherally in the wheels 8. The belt is gripped between the centre of the toothing of the elements 6 and the centre of the base 5*d* of the corresponding elements 5*a*, 5*b*. The member 5*a* is provided with a vertical through bore 10, which houses a relative socket locked in position by the dowel 11. The sockets of the belt 1 form a seat for housing the cap 13 of the capsules and comprise a restriction 12*a* at their lower edge, which retains the cap but allows the capsule case 14 to protrude downwards. The cases are housed in the sockets 15 inserted into bores in the member 5*a*** of the lower belt, these sockets also being provided with a lower restriction.

As shown in FIG. 1, the belts 1 and 2 both wind about a known capsule feed, positioning and separation unit 16. The capsules fall vertically in the closed state and their cases partially penetrate the sockets 12. The cases are urged by known suction means to fall into the underlying sockets 15. The belts 1 and 2 then proceed, one superimposed on the other, towards the pair of idle wheels 17. A resilient member acts horizontally on the blocks 4 of one belt from the outside inwards, at the centre of the portion extending from the unit 16 to the idle wheels 17, while the inner face of the other belt rests against the stop 19 in a corresponding position. If the capsule cap has been separated from the case, one belt becomes displaced with respect to the other, while if this separation has not taken place, a senser cooperating with the member 18 detects this fact and activates means for expelling the capsule which operate as the belts enter the wheels 17. After leaving these wheels, the belt 2 winds about the idle wheel 20 and proceeds to the wheel 21 which controls the dispenser 22, which fills the cases 14 with the predetermined product doses. The belt 1 is instead deviated by the wheels 23 and 24. Subsequently both belts are led to the capsule closing and removal unit 25, then returning together to the unit 16. The idle wheels 20 and 24 external to the belts are provided with cavities analogous to those indicated by the reference numeral 9 for engagement by the members 5*a*. The winding about the pulleys 20, 24 is facilitated by the curved shape of the bases 5*d*, which have the same radius of curvature as the idle wheels 20, 24.

I claim:

1. Conveyor for conveying capsules composed of a case and cap in machines for filling said capsules with doses of pulverulent or granular product and which comprises an assembly for feeding the capsules in their closed state and incorporating means for separating the case from the cap, a dispensing assembly arranged to insert a predetermined product dose into the capsule case, and a capsule closing assembly, the conveyor comprising a pair of toothed belts of equal length in the form of endless loops and lying in two horizontal planes, the belts being wound about idle pulleys to convey the capsules from the feed assembly to the dispensing assembly and from this latter to the closing assembly, a plurality of blocks supported at equal distances along the belts, each block of the upper belt being provided with a seat for housing the cap of one capsule, and each block of the lower belt being provided with a seat for housing the case of the same capsule, the seats being mutually aligned, at least when in a position corresponding with the capsule feed assembly, to receive the capsule and wherein each of the blocks comprises a first element composed of a member external to the belts and of cylindrical shape, rigid with which there is a species of fork comprising two arms which extend above and below the belt towards the interior of this latter, and a second element fixed between the arms of the fork to clamp the belt against the base of the fork, the second element comprising a peripheral cylindrical surface concentric with that of said member, said member and said second element comprising holes for housing sockets for supporting the capsule cap and case.

2. Conveyor as claimed in claim 1, wherein that surface of the second element facing the belt is provided with toothing complementary to the belt toothing, the base of the fork being cylindrical with a radius of curvature substantially equal to the radius of curvature of the idle wheels for the belts.

* * * * *